US010190601B2

(12) United States Patent
Dygert et al.

(10) Patent No.: US 10,190,601 B2
(45) **Date of Patent: *Jan. 29, 2019**

(54) SHROUDED AXIAL FAN WITH CASING TREATMENT

(71) Applicant: Carrier Corporation, Farmington, CT (US)

(72) Inventors: Ryan K. Dygert, Cicero, NY (US); Peter R. Bushnell, Cazenovia, NY (US)

(73) Assignee: CARRIER CORPORATION, Farmington, CT (US)

( * ) Notice: Subject to any disclaimer, the term of this patent is extended or adjusted under 35 U.S.C. 154(b) by 635 days.

This patent is subject to a terminal disclaimer.

(21) Appl. No.: 14/760,581

(22) PCT Filed: Dec. 10, 2013

(86) PCT No.: PCT/US2013/074054

§ 371 (c)(1),
(2) Date: Jul. 13, 2015

(87) PCT Pub. No.: WO2014/109850

PCT Pub. Date: Jul. 17, 2014

(65) Prior Publication Data

US 2015/0354598 A1 Dec. 10, 2015

Related U.S. Application Data

(60) Provisional application No. 61/751,600, filed on Jan. 11, 2013.

(51) Int. Cl.
*F04D 29/66* (2006.01)
*F04D 19/00* (2006.01)
(Continued)

(52) U.S. Cl.
CPC ..... *F04D 29/663* (2013.01); *F04D 19/002* (2013.01); *F04D 29/164* (2013.01);
(Continued)

(58) Field of Classification Search
CPC .... F04D 29/663; F04D 29/164; F04D 29/325; F04D 29/326; F04D 29/522;
(Continued)

(56) References Cited

U.S. PATENT DOCUMENTS 5,489,186 A * 2/1996 Yapp ..... F01D 5/141 415/208.3
9,885,368 B2 * 2/2018 Dygert ..... F04D 29/526
(Continued)

FOREIGN PATENT DOCUMENTS

CN 2743585 Y 11/2005
CN 101668678 A 3/2010
(Continued)

OTHER PUBLICATIONS

State Intellectual Property Office of People's Republic China Search Report; Application No. 201380070019.7; dated Sep. 13, 2016; 3 pages.

(Continued)

*Primary Examiner* — Richard Edgar
(74) *Attorney, Agent, or Firm* — Cantor Colburn LLP

(57) ABSTRACT

A fan assembly (10) includes a shrouded fan rotor (24) including a plurality of fan blades (28) extending from a rotor hub (30) and rotatable about a central axis (26) of the fan assembly and a fan shroud (32) extending circumferentially around the fan rotor (24) and secured to the plurality of fan blades (28). The shroud (32) has a first axially extending annular portion (38) secured to the plurality of fan blades (28), a second axially extending annular portion (40) radially outwardly spaced from the first axially extending
(Continued)

annular portion (38), and a third portion (44) connecting the first (38) and second (40) axially extending annular portions. A casing (22) is positioned circumferentially around the fan shroud (32) defining a radial clearance between the casing and the fan shroud. The casing (22) includes a plurality of casing elements (48) extending from a radially inboard surface (46) of the casing toward the shroud (32) and defining a radial element gap and an axial element gap.

20 Claims, 13 Drawing Sheets

(51) Int. Cl.

| | |
|---|---|
| ***F04D 29/32*** | (2006.01) |
| ***F04D 29/52*** | (2006.01) |
| ***F04D 29/54*** | (2006.01) |
| ***F04D 29/16*** | (2006.01) |
| ***F04D 29/68*** | (2006.01) |

(52) U.S. Cl.
CPC ..... *F04D 29/325* (2013.01); *F04D 29/326* (2013.01); *F04D 29/522* (2013.01); *F04D 29/526* (2013.01); *F04D 29/542* (2013.01); *F04D 29/685* (2013.01)

(58) Field of Classification Search
CPC .... F04D 29/526; F04D 29/542; F04D 29/685; F04D 19/002
See application file for complete search history.

(56) References Cited

U.S. PATENT DOCUMENTS

| | | | | |
|---|---|---|---|---|
| 2002/0164247 | A1 | 11/2002 | Nadeau et al. | |
| 2007/0280827 | A1* | 12/2007 | Stevens | F04D 29/326 415/220 |
| 2008/0075585 | A1* | 3/2008 | Acre | F04D 29/164 415/177 |
| 2010/0119366 | A1* | 5/2010 | Bushnell | F04D 29/544 415/208.2 |

FOREIGN PATENT DOCUMENTS

| | | | | |
|---|---|---|---|---|
| DE | 102006039007 | A1 | 8/2006 | |
| EP | 1340921 | A2 | 9/2003 | |
| EP | 2386864 | A2 * | 11/2011 | F04D 29/164 |
| EP | 2447542 | A2 | 5/2012 | |
| WO | 2006063825 | A1 | 6/2006 | |
| WO | 2008022739 | A1 | 2/2008 | |

OTHER PUBLICATIONS

Notification of Transmittal of the International Search Report and the Written Opinion of the International Searching Authority; PCT/US2013/074054; European Patent Office; dated Apr. 28, 2014; 13 pages.

* cited by examiner

SHROUDED AXIAL FAN WITH CASING TREATMENT

BACKGROUND

The subject matter disclosed herein relates to shrouded axial flow fans. More specifically, the subject matter disclosed herein relates to structure to reduce aerodynamic noise and increase stall margin of shrouded axial flow fans.

Axial flow fans are widely used in many industries ranging from automotive to aerospace to HVAC but are typically limited in their application by operating range restrictions and noise considerations. While vane-axial fans can achieve high static efficiencies, noise generation from fluid interaction between the rotating fan and the stationary stator vanes often limits their use considerably. Further restrictions imposed by limited operating range due to blade stall typically make the vane-axial fan impractical for use in systems requiring appreciable static pressures without resorting to high rotational speeds, thereby compounding existing noise problems. Of particular importance to the stability and operating range of the axial fan is the nature of the tip clearance or shroud recirculation flow. In this case, a rotating shrouded fan is considered in which a circumferential band unitarily connects the outboard tips of the blades.

BRIEF DESCRIPTION

In one embodiment, a fan assembly includes a shrouded fan rotor including a plurality of fan blades extending from a rotor hub and rotatable about a central axis of the fan assembly and a fan shroud extending circumferentially around the fan rotor and secured to the plurality of fan blades. The shroud has a first axially extending annular portion secured to the plurality of fan blades, a second axially extending annular portion radially outwardly spaced from the first axially extending annular portion, and a third portion connecting the first and second axially extending annular portions. A casing is positioned circumferentially around the fan shroud defining a radial clearance between the casing and the fan shroud. The casing includes a plurality of casing elements extending from a radially inboard surface of the casing toward the shroud and defining a radial element gap between a first element surface and a maximum radius point of the shroud and an axial element gap between a second element surface and an upstream end of the fan shroud.

In another embodiment, a casing assembly for an axial flow fan includes a casing inner surface extending circumferentially around a central axis of the fan. A plurality of casing elements extend radially inwardly from the casing inner surface. Each casing element includes a first element surface defining a radial element gap between the first element surface and a fan rotor, and a second element surface defining an axial element gap between the second element surface and an upstream end of the fan rotor.

These and other advantages and features will become more apparent from the following description taken in conjunction with the drawings.

BRIEF DESCRIPTION OF THE DRAWINGS

The subject matter, which is regarded as the invention, is particularly pointed out and distinctly claimed in the claims at the conclusion of the specification. The foregoing and other features, and advantages of the invention are apparent from the following detailed description taken in conjunction with the accompanying drawings in which:

Figure 1:
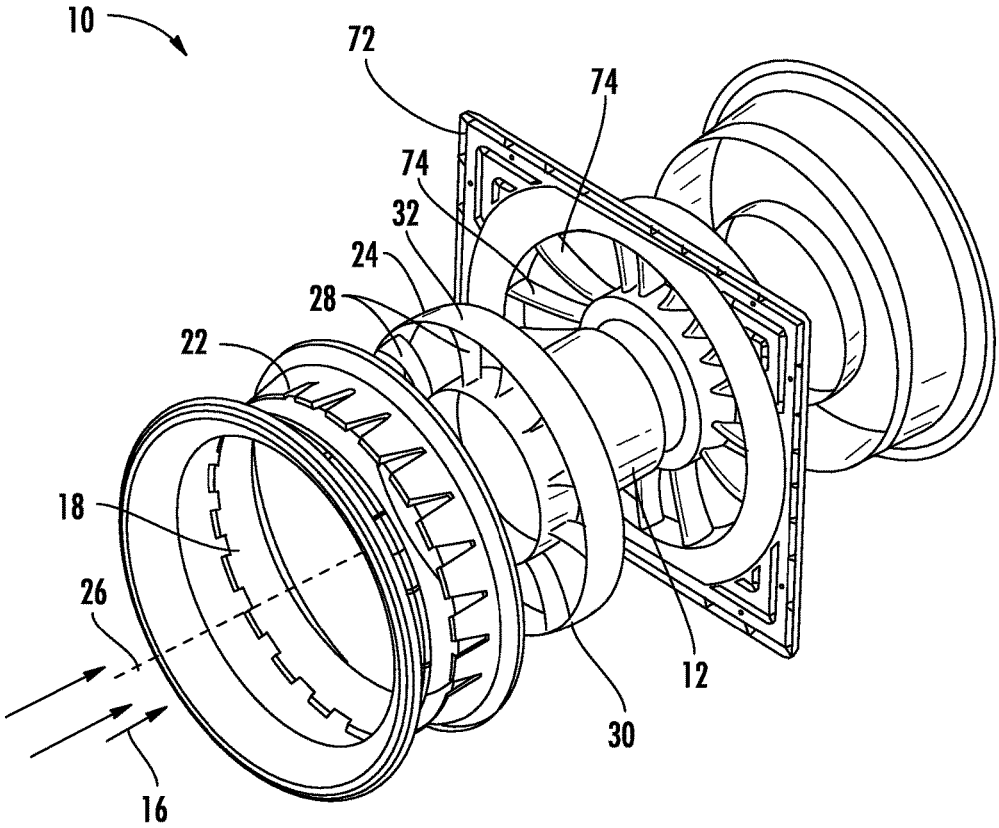
FIG. 1 is a perspective view of an embodiment of a fan assembly.

The detailed description explains embodiments of the invention, together with advantages and features, by way of example with reference to the drawing.

DETAILED DESCRIPTION OF THE INVENTION

Shown in FIG. 1 is an embodiment of an axial-flow fan 10 utilized, for example in a heating, ventilation and air conditioning (HVAC) system as an air handling fan. The fan 10 may be driven by an electric motor 12 connected to the fan 10 by a shaft (not shown), or alternatively a belt or other arrangement. In operation, the motor 12 drives rotation of the fan 10 to urge airflow 16 across the fan 10 and along a flowpath 18, for example, from a heat exchanger (not shown). The fan 10 includes a casing 22 with a fan rotor 24, or impeller rotably located in the casing 22. Operation of the motor 12 drives rotation of the fan rotor 24 about a fan axis 26. The fan rotor 24 includes a plurality of fan blades 28 extending from a hub 30 and terminating at a fan shroud 32. The fan shroud 32 is connected to one or more fan blades 28 of the plurality of fan blades 28 and rotates about the fan axis 26 therewith. In some embodiments, the fan 10 further includes a stator assembly 72 including a plurality of stator vanes 74, located either upstream or downstream of the fan rotor 24. In some embodiments, the fan 10 has a hub 30 diameter to fan blade 28 diameter ratio between about 0.45 and 0.65. Further the fan 10 nominally operates in a rotational speed between about 1500 RPM and about 2500 RPM with a fan blade 28 tip speed of about 0.1 Mach or less.

Figure 2:
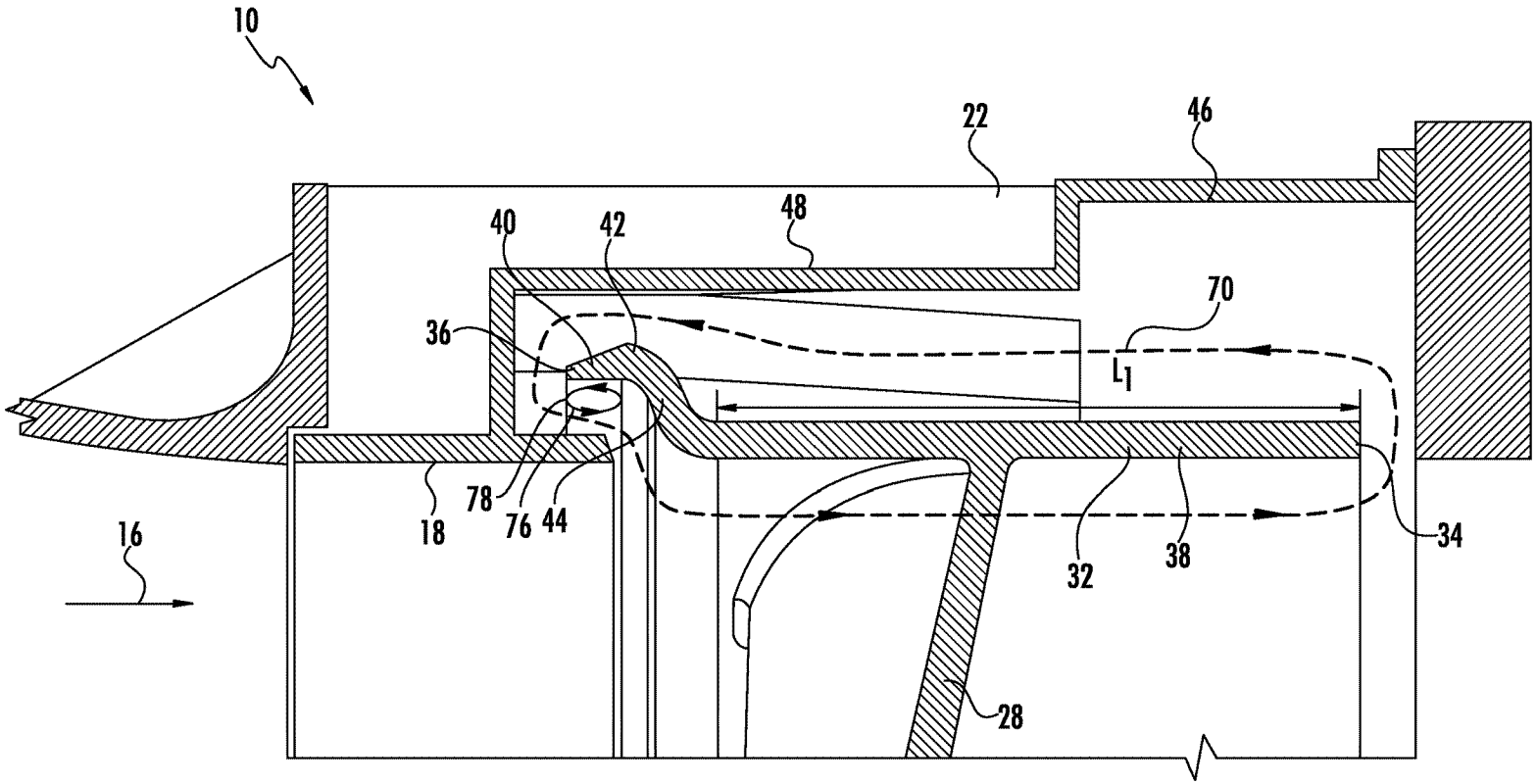
FIG. 2 is a partial cross-sectional view of an embodiment of a fan assembly illustrating a fan shroud and casing interface.
Figure 2A:
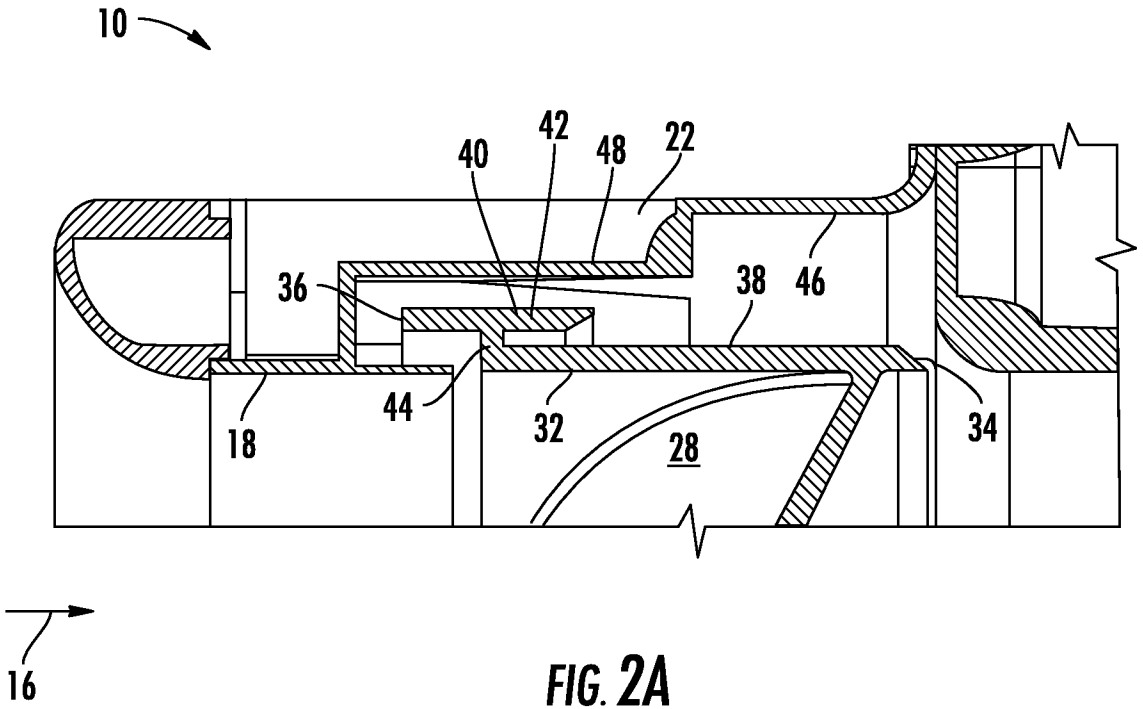
FIG. 2A is a partial cross-sectional view of another embodiment of a fan assembly illustrating a fan shroud and casing interface.
Figure 2B:
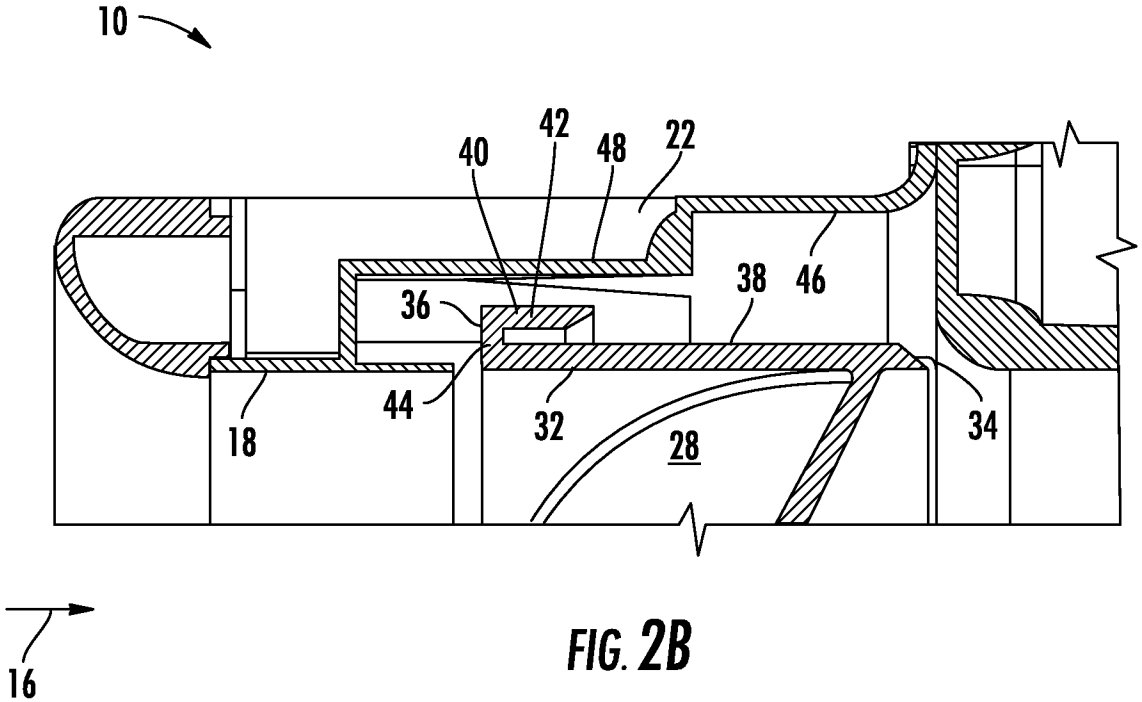
FIG. 2B is a partial cross-sectional view of yet another embodiment of a fan assembly illustrating a fan shroud and casing interface.

Referring to FIG. 2, the fan shroud 32 defines a radial extent of the fan rotor 24, and defines running clearances between the fan rotor 24, in particular the fan shroud 32, and the casing 22. During operation of the fan 10, a recirculation flow 70 is established from a downstream end 34 of the fan shroud 32 toward an upstream end 36 of the fan shroud 32, where at least some of the recirculation flow 70 is reingested into the fan 10 along with airflow 16. This reingestion may be at an undesired angle or mass flow, which can result in fan instability or stall. To alleviate this, the fan shroud 32 extends substantially axially from the downstream end 34 of the fan shroud 32 toward the upstream end 36 of the fan shroud 32 along a first portion 38 for a length $L_1$, which may be a major portion (e.g. 80-90%) of a total shroud length $L_{tot}$. The first portion 38 of the fan shroud 32 is connected to the fan blades 28. A second portion 40 of the fan shroud 32 also may extend in an axial direction, but is offset radially outwardly from the first portion 38, and defines a maximum radius 42 of the fan shroud 32. A third portion 44 connects the first portion 38 and the second portion 40. In some embodiments, as shown in FIG. 2, this results in a substantially s-shaped cross-section of the fan shroud 32. In other embodiments, for example, as shown in FIGS. 2*a*-2*b*, the resulting cross-section is T-shaped and J-shaped, respectively. During operation, the fan shroud 32 forms a separation bubble 76 of flow between the upstream end 36 and the casing 22. This separation bubble 76 is a small recirculation zone that creates an effectively smaller running clearance gap 78 between upstream end 36 and casing 22, thereby limiting the amount of recirculation flow 70 through the running clearance gap 78.

The casing 22 includes a casing inner surface 46, which in some embodiments is substantially cylindrical or alternatively a truncated conical shape, extending circumferentially around the fan shroud 32. Further, the casing 22 includes a plurality of casing elements, or casing wedges 48 extending radially inboard from the casing inner surface 46 toward the fan shroud 32 and axially at least partially along a length of the fan shroud 32. The casing wedges 48 may be separate from the casing 22, may be secured to the inner surface 46, or in some embodiments may be formed integral with the casing 22 by, for example, injection molding. While the description herein relates primarily to casing wedges 48, in other embodiments other casing elements, such as casing fins 148 shown in FIG. 3*a*, may be utilized.

Figure 3:
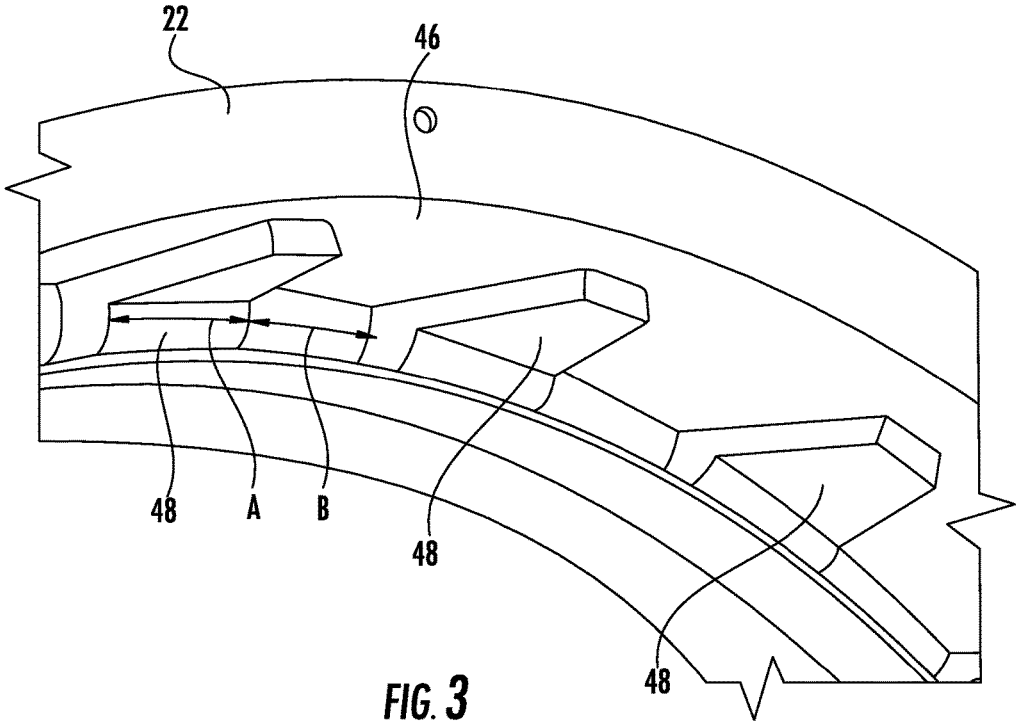
FIG. 3 is an isometric view of an embodiment of a casing for a fan assembly.
Figure 3A:
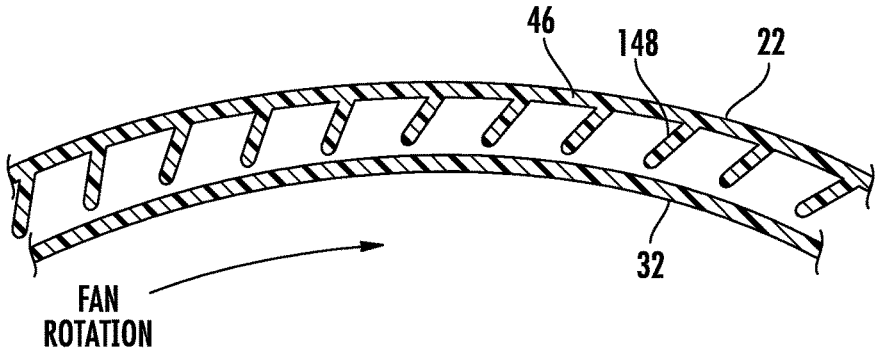
FIG. 3A is a partial cross-sectional view of another embodiment of a casing for a fan assembly.

Referring to FIG. 3, the casing wedges 48 are arrayed about a circumference of the casing 22, and in some embodiments are at equally-spaced intervals about the circumference. The number of casing wedges 48 is variable and depends on a ratio of wedge width A of each wedge to opening width B between adjacent wedges expressed as A/B as well as a ratio of wedge width A to fan shroud 32 circumference, expressed as $A/\pi D$, where D is a maximum diameter of the fan shroud 32. In some embodiments, ratio A/B is between 0.5 and 4, though may be greater or lesser depending on an amount of swirl reduction desired. In some embodiments, ratio $A/\pi D$ is in the range of about 0.01 to 0.25. Further, the number of casing wedges 48 may be selected such as not to be a multiple of the number of fan blades 28 to avoid detrimental tonal noise generation between the recirculation flow 70 emanating from the casing wedges 48 and the rotating fan blades 28. In some embodiments, the fan rotor 24 has 7, 9 or 11 fan blades 28.

Figure 4:
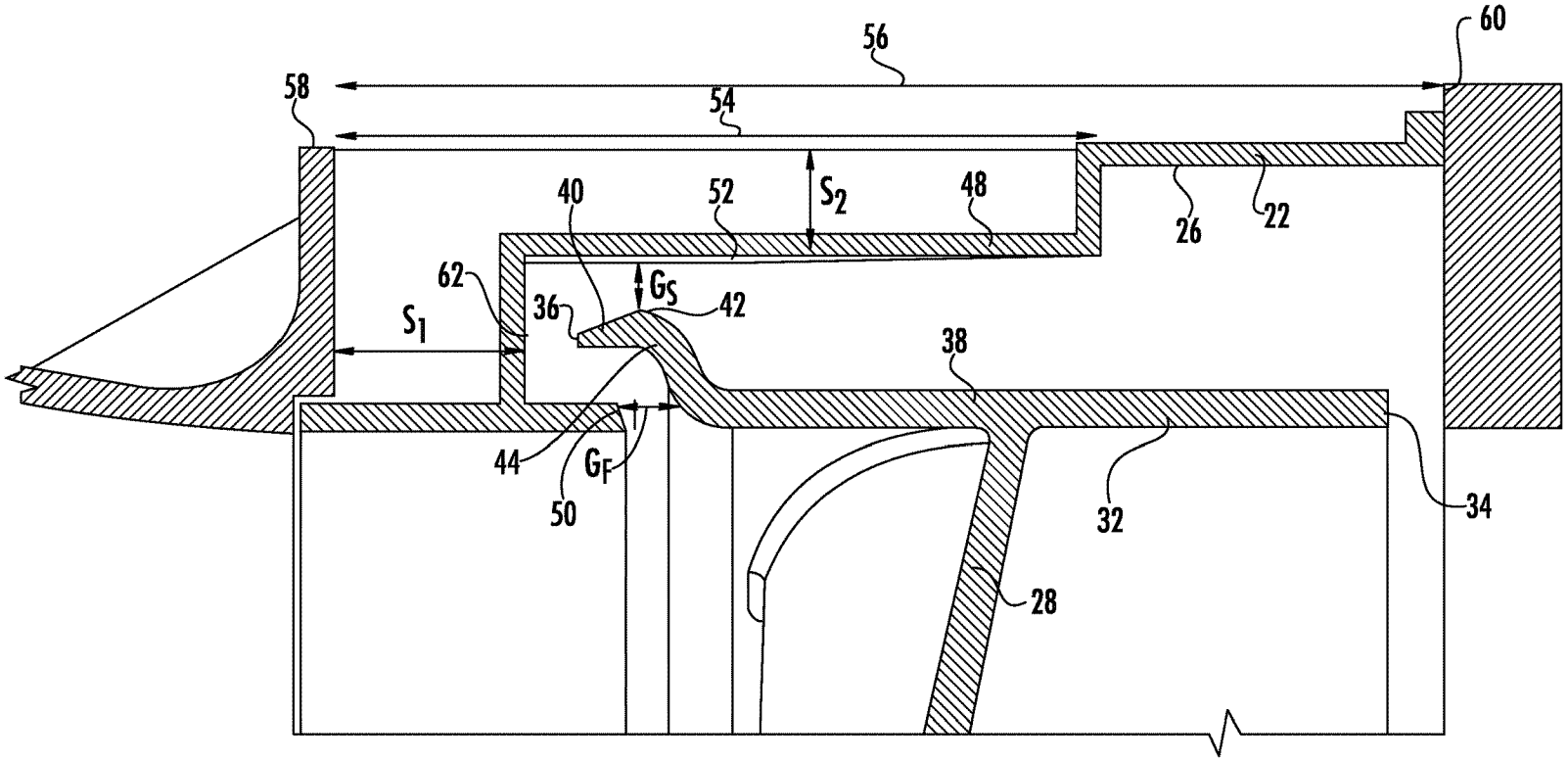
FIG. 4 is another partial cross-sectional view of an embodiment of a fan assembly illustrating a fan shroud and casing interface.

Referring again to FIG. 2, the casing wedges 48 in some embodiments are shaped to conform to and wrap around the second portion 40 of the fan shroud 32, leaving minimum acceptable running clearances between the casing wedges 48 and the fan shroud 32. Thus, as shown in FIG. 4, the casing wedges 48 result in an axial step $S_1$ from a forward end 52 of the casing 22 and a radial step $S_2$ from the casing inner surface 46 at each casing wedge 48 around the circumference of the casing 22. A magnitude of the step $S_1$ is between $1*G_F$ and $20*G_F$, where $G_F$ is an axial offset from a forward flange 50 of the casing 22 to the second portion 40 of the fan shroud 32. Similarly, a magnitude of $S_2$ is between $1*G_S$ and $20*G_S$, where $G_S$ is a radial offset from the maximum radius location 42 to a radially inboard surface 52 of the casing wedge 48. An axial wedge length 54 is between 25% and 100% of an axial casing length 56. Further, the radially inboard surface 52, while shown as a substantially radial surface, may be tapered along the axial direction such that $S_2$ decreases, or increases, along the axial wedge length 54 from an upstream casing end 58 to a downstream casing end 60. A forward wedge surface 62, which defines $S_1$, while shown as a flat axial surface, may be similarly tapered such that $S_1$ decreases, or increases or both, with radial location along the forward wedge surface 62. In other embodiments, forward wedge surface 62 may have a curvilinear cross-section.

Figure 4A:
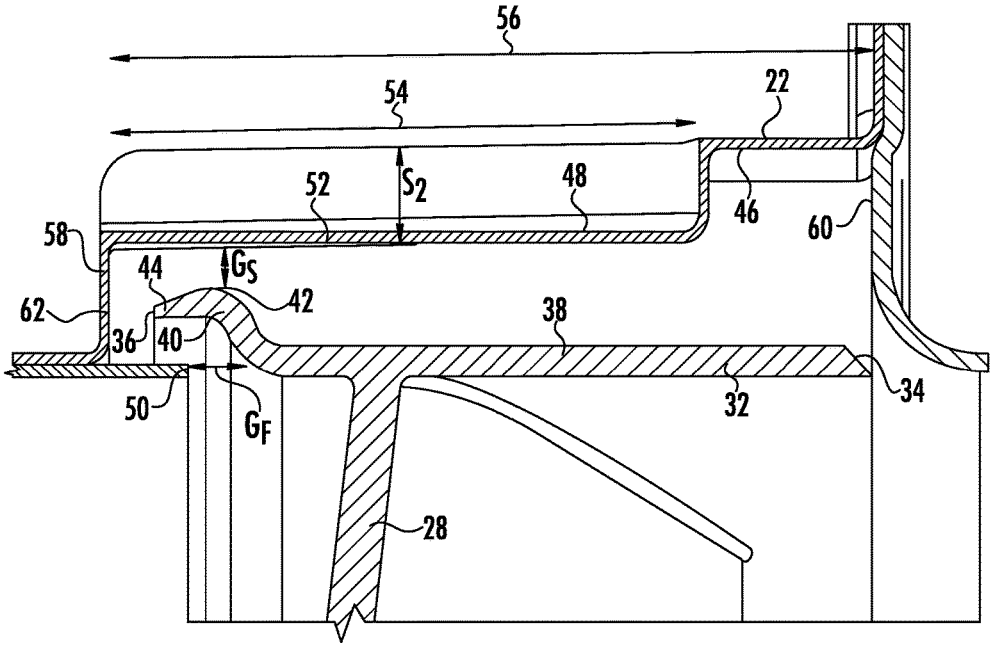
FIG. 4*a* is a partial cross-sectional view of another embodiment fan assembly illustrating a fan shroud and casing interface.

Referring to FIG. 4*a*, the forward wedge surface 62 of some embodiments may coincide with the forward casing surface 58. In such cases, the forward axial step S1 is zero. The forward casing surface 58 may be a constant radial surface or may be a curvilinear surface.

Figure 5:
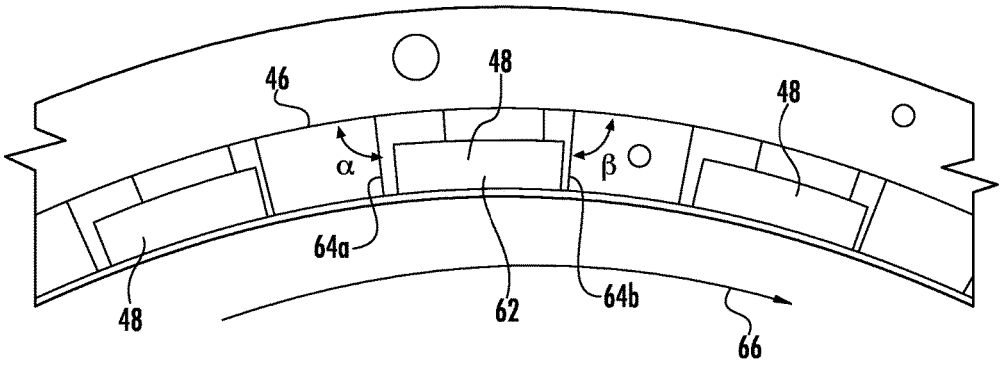
FIG. 5 is another upstream-facing cross-sectional view of an embodiment of a rotor casing illustrating angles formed between casing wedge sides and tangents to the casing.

Referring to FIG. 5, wedge sides 64*a* and 64*b* of the casing wedges 48 form angles α and β, respectively at an intersection with a tangent of the casing inner surface 46, where side 64*a* is a leading side relative to a rotation direction 66 of the fan rotor 24 and 64*b* is a trailing side relative to the rotation direction 66. In some embodiments, α and β are in the range of 30° and 150° and may or may not be equivalent, complimentary or supplementary. The wedge sides 64*a* and 64*b* may be, for example, substantially planar as shown or may be curvilinear along a radial direction.

Figure 6:
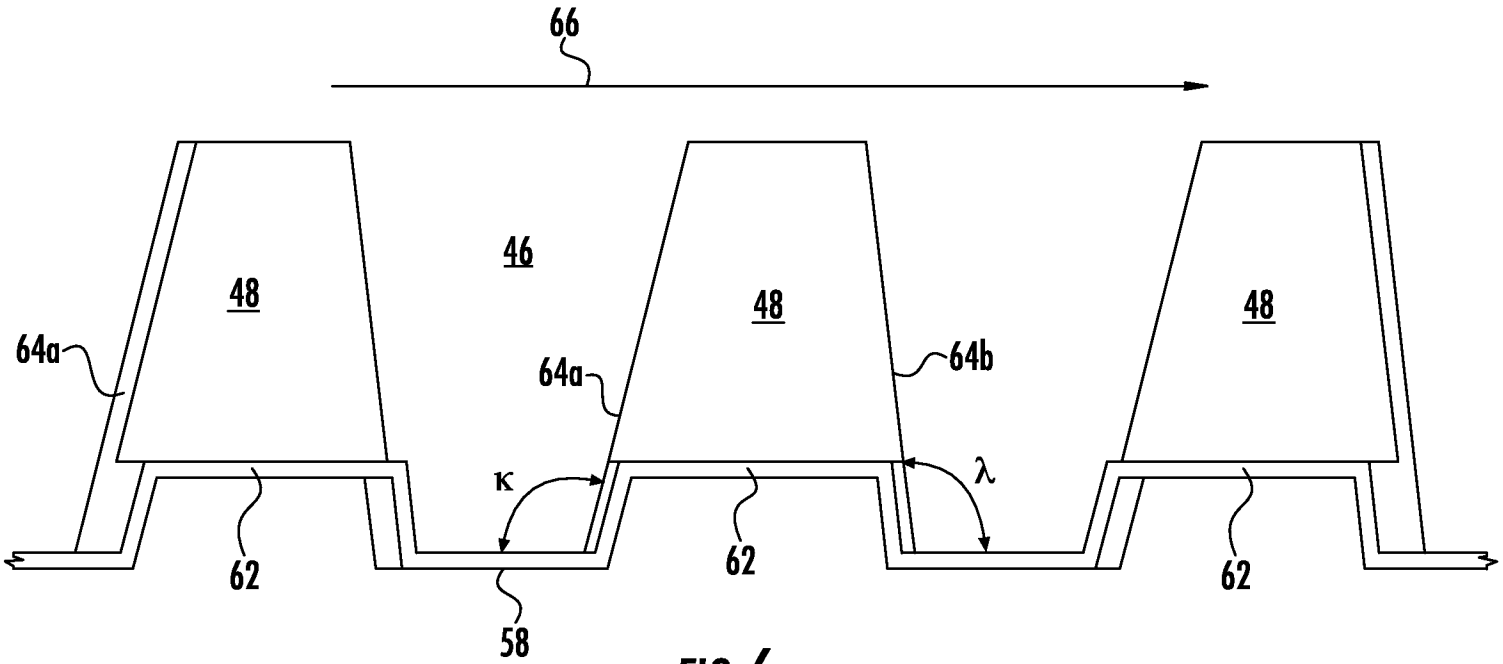
FIG. 6 is a plan view of an interior of an embodiment of a casing.

Referring to FIG. 6, in the axial direction, wedge sides 64*a* and 64*b* form angles K and λ respectively with the upstream casing end 58. In some embodiments, K and λ are between 90° and 150°, while in other embodiments, K and λ may be less than 90°. In embodiments where the casing wedges 48 are co-molded with the casing 22, K and λ greater than 90° are desired to enable the use of straight pull tooling. With other manufacturing methods, however, K and λ of less than 90° may be desirable. Angles K and λ may or may not be equivalent, supplementary or complimentary. Further, while the wedge sides 64*a* and 64*b* are depicted as substantially planar, they may be curvilinear along the axial direction.

Selecting angles α, β, K, and λ and axial and radial steps $S_1$ and $S_2$ as well as gaps $G_F$ and $G_S$ allows a reinjection angle of the recirculation flow 70 and a mass flow of the recirculation flow 70 to be selected and controlled.

Figure 7:
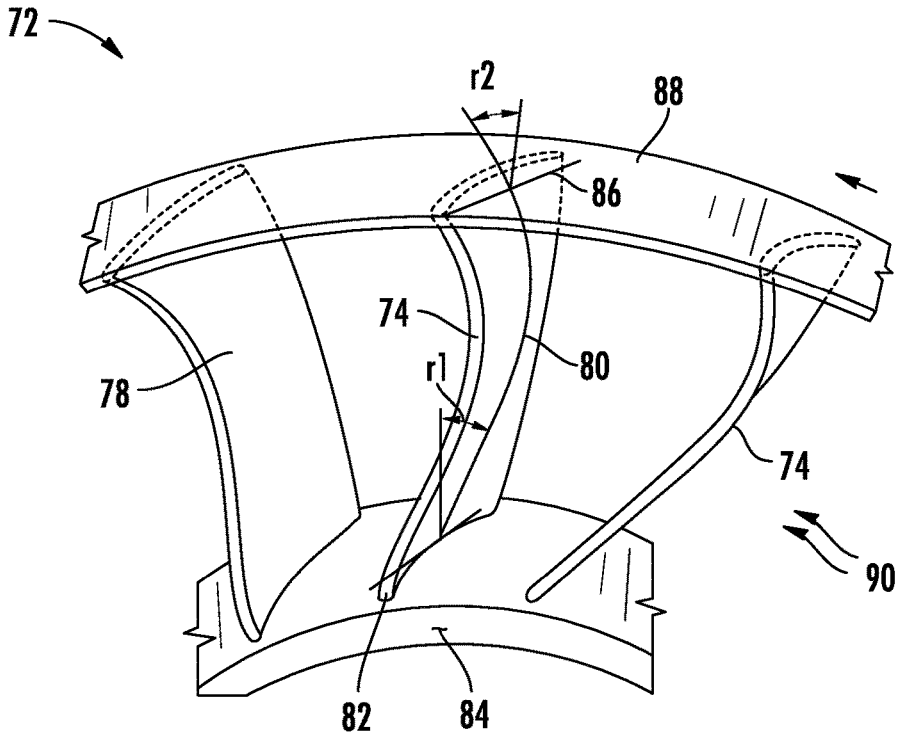
FIG. 7 is a perspective view illustrating an embodiment of circumferentially swept stator vanes.
Figure 8:
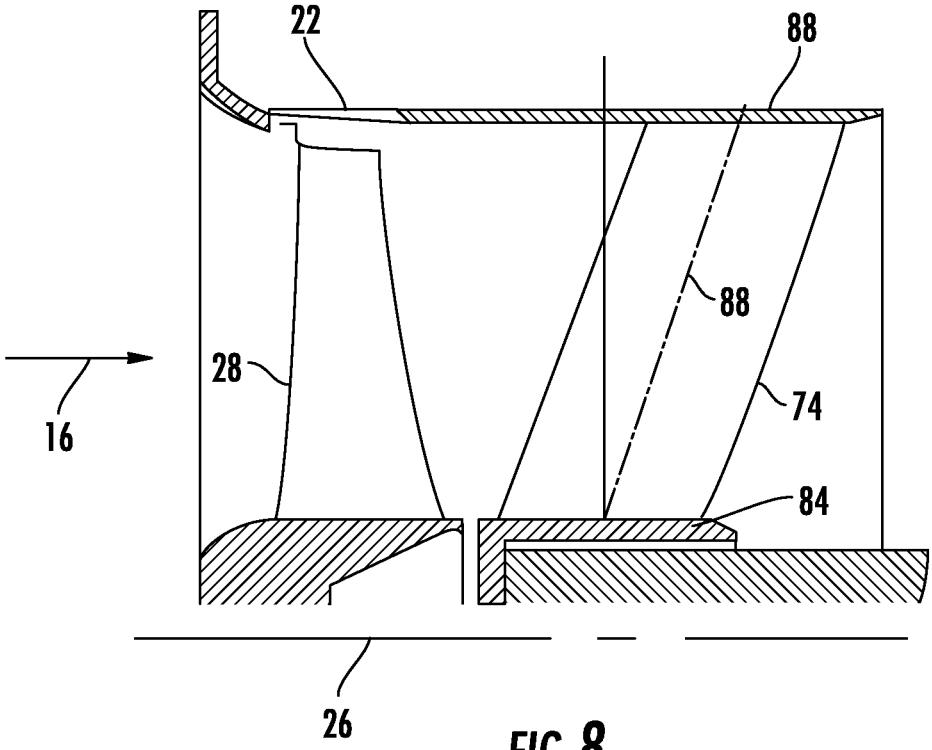
FIG. 8 is a cross-sectional view illustrating an embodiment of axially swept stator vanes.

Referring now to FIGS. 7 and 8, in some embodiments, the stator vanes 74 are positioned to include lean or sweep in a circumferential and/or axial direction. The stator vanes 74 straighten flow 16 exiting from the fan rotor 24, transforming swirl kinetic energy in the flow 16 into static pressure rise across the stator vanes 74. As shown in FIG. 7, each vane 74 has a stacking axis 80 that extends from a vane base 82 at a stator hub 84 outwardly to a vane tip 86 at a stator shroud 88. At the vane base 82, the stacking axis 80 leans circumferentially from a radial direction at an angle r1 of about 10 degrees to about 25 degrees toward a swirl direction 90 of the flow 16. This degree of lean continues for about 75% of vane 74 span, where it changes direction to lean away from the swirl direction 90 at an angle r2 of about 20 degrees to about 40 degrees. Further, as shown in FIG. 8, the vanes 74 include an axial sweep of the stacking axis 80. This axial sweep results in a reduced level of rotor-stator interaction noise, while maintaining aerodynamic performance characteristics of the fan 10.

Figure 9:
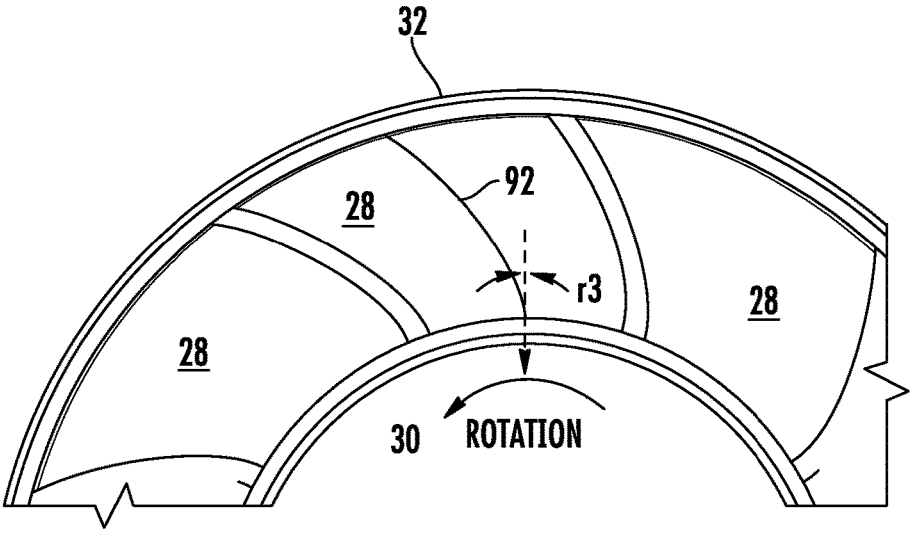
FIG. 9 is a perspective view illustrating an embodiment of circumferentially swept fan blades.

Referring now to FIG. 9, in some embodiments, the fan blades 28 include circumferential lean or sweep. Each fan blade 28 has a blade stacking axis 92 that leans circumferentially from a radial direction at an angle r3 between −60 degrees and +60 degrees. Circumferential fan blade 28 sweep is used to selectively drive flow inboard or outboard along the blade span to provide the desired rotor outflow profile to be seen by the stator vanes 74. Using this technique, multiple fan blade 28 designs can be produced in which the operating range of the rotor-stator combination is shifted to either lower or higher volume flow rates while using the same stator vane 74 design. Here, the circumferential fan blade 28 lean is tailored to produce the correct rotor outflow profile, thereby allowing the stator vanes 74 to still operate effectively. The fan blade 28 may be swept circumferentially forward into the incoming flow 16 to drive flow inboard to the rotor hub 30, may be swept circumferentially rearward to drive flow outboard to the tip region of the fan blade 28, or may be swept circumferentially in a combination of the two to migrate flow within the blade passage as desired, with the possibility of simultaneously driving flow inboard towards the hub 30 and outboard towards the tip. The amount of circumferential fan blade 28 sweep will depend on the amount of flow migration desired for the particular application and will be dictated largely by the stator vane 74 design and the desired operating envelope. Another significant result of the use of circumferentially swept fan blades 28 is to aid in the dephasing of the interaction between the fan blade 28 wakes and the stationary stator vanes 74, thereby reducing the noise level of the fan 10 allowing for use of fan 10 in noise-limited environments such as residential environments.

While the invention has been described in detail in connection with only a limited number of embodiments, it should be readily understood that the invention is not limited to such disclosed embodiments. Rather, the invention can be modified to incorporate any number of variations, alterations, substitutions or equivalent arrangements not heretofore described, but which are commensurate with the spirit and scope of the invention. Additionally, while various embodiments of the invention have been described, it is to be understood that aspects of the invention may include only some of the described embodiments. Accordingly, the invention is not to be seen as limited by the foregoing description, but is only limited by the scope of the appended claims.

The invention claimed is:

1. A fan assembly comprising:

a shrouded fan rotor including:

a plurality of fan blades extending from a rotor hub and rotatable about a central axis of the fan assembly; and a fan shroud extending circumferentially around the fan rotor and secured to the plurality of fan blades, the shroud having:

a first axially extending annular portion secured to the plurality of fan blades;

a second axially extending annular portion radially outwardly spaced from the first axially extending annular portion; and a third portion connecting the first and second axially extending annular portions; and a casing disposed circumferentially around the fan shroud defining a radial clearance between the casing and the fan shroud, the casing including a plurality of casing elements extending from a radially inboard surface of the casing toward the shroud and defining a radial element gap between a first element surface and a maximum radius point of the shroud and an axial element gap between a second element surface and an upstream end of the fan shroud.

2. The fan assembly of claim 1, wherein the fan shroud has one of an S-shaped cross-section, a J-shaped cross-section, or a T-shaped cross-section.

3. The fan assembly of claim 1, wherein the plurality of casing elements are a plurality of fins extending radially inwardly from the casing.

4. The fan assembly of claim 1, wherein the plurality of casing elements are a plurality of casing wedges extending radially inwardly from the casing.

5. The fan assembly of claim 4, wherein a number of casing wedges is not a multiple of a number of fan blades.

6. The fan assembly of claim 1, wherein a radial distance of the first element surface from an inner casing surface is between about one and twenty times the radial element gap.

7. The fan assembly of claim 6, wherein the axial distance varies along a radial direction.

8. The fan assembly of claim 1, wherein an axial distance of the second element surface from an upstream end of the casing is between about one and twenty times an axial clearance between the fan shroud and the casing.

9. The fan assembly of claim 8, wherein the radial distance varies along an axial casing element length.

10. The fan assembly of claim 1, further comprising a stator assembly including a plurality of stator vanes, disposed upstream and/or downstream of the fan rotor, the plurality of stator vanes having a circumferential lean or sweep along at least a portion of a stator vane span.

11. The fan assembly of claim 10, wherein an amount of circumferential sweep is between about 10 degrees and 25 degrees.

12. The fan assembly of claim 10, wherein an amount of circumferential sweep is between about 20 and 40 degrees.

13. The fan assembly of claim 10, wherein the plurality of stator vanes are axially swept.

14. The fan assembly of claim 1, wherein the plurality of fan blades are circumferentially swept.

15. The fan assembly of claim 1, wherein the fan rotor has a hub diameter to fan blade diameter ratio between about 0.45 and about 0.65.

16. The fan assembly of claim 1, wherein the fan rotor operates at a rotational speed between about 1500 rpm and 2500 rpm.

17. The fan assembly of claim 16, wherein a fan blade tip speed is about 0.1 Mach or less.

18. The fan assembly of claim 1, wherein the second element surface is coincident with a forward surface of the casing such that an axial gap exists between a forward casing surface and an upstream end of the fan shroud.

19. The fan assembly of claim 1, wherein an axial casing element length is between about 25% and 100% of an axial casing length.

20. The fan assembly of claim 4, wherein each casing wedge includes a planar first radial wedge side and a planar second radial wedge side extending from an upstream end of the casing, the first radial wedge side and the second radial wedge side form angles with tangents of a casing inner surface between about 30 and 150 degrees.

* * * * *